United States Patent [19]

Hensel

[11] 4,236,566

[45] Dec. 2, 1980

[54] EXTERNAL VENETIAN BLIND

[75] Inventor: Erich E. Hensel, Wassenaar, Netherlands

[73] Assignee: Hunter Douglas International N.V., Netherlands Antilles

[21] Appl. No.: 963,126

[22] Filed: Nov. 22, 1978

[30] Foreign Application Priority Data

Nov. 24, 1977 [DE] Fed. Rep. of Germany ..... 2752388

[51] Int. Cl.[3] ..... E06B 3/48; E06B 9/00

[52] U.S. Cl. ..... 160/130

[58] Field of Search ..... 160/133, 168–178, 160/183, 193, 202

[56] References Cited

U.S. PATENT DOCUMENTS

| | | | |
|---|---|---|---|
| 3,053,318 | 9/1962 | Artman | 160/183 |
| 3,324,929 | 5/1967 | Griesser | 160/133 |

*Primary Examiner*—Peter M. Caun

*Attorney, Agent, or Firm*—Pennie & Edmonds

[57] ABSTRACT

An external venetian blind is disclosed having a plurality of slats (10) which in the closed position overlap each other and at least two flexible lifting elements (14) extend through openings (20) in the slats (10). One edge (12) of each slat is offset along a bend line (15) to help in guiding the slats during opening and closing of the blind. In one embodiment shown in FIG. 1 the offset edge portion (12) lies substantially parallel to the lifting elements (14) while in the preferred embodiment of FIG. 3 the offset edge (12) lies at an angle of up to 10° with respect to the lifting elements (14). This angle is preferably 3° to 6° with 5° being the most preferred. The lower edge (17) of the slats (10) is rolled inwardly and has secured thereto a resilient sealing strip (18) to bear against the next lower slat in the closed position to insure quietness of operation and the secure elimination of light penetration through the blind. The openings (20) are in part in the main portion (11) of the blind and in part in the offset edge portion (12). Edges (16, 21) of the openings are curved to avoid abrasion of the lifting elements (14).

7 Claims, 3 Drawing Figures

EXTERNAL VENETIAN BLIND

BACKGROUND OF THE INVENTION

In external blinds of conventional construction, the slats are in most cases in their closed position during lifting. Openings are formed in the slats for the purpose of passing the lifting elements therethrough. The abrasion of the lifting elements against the edges of the opening causes extensive wear of the lifting elements, and this is coupled with a frequently annoying generation of noise. Wear and noise are also present if, in the closed position of the external blind, the lifting elements and the slats strike one another due to the action of the wind. Furthermore, the exclusion of light frequently is not complete in particular with relatively large blinds. This can occur, for example, because the slats are not in an exactly horizontal position throughout after the blind has been let down such that one end is higher than the other. On the other hand, the cause may be that they are prevented from firm contact by external influences, such as the wind.

BRIEF SUMMARY OF THE INVENTION

The present invention provides an external Venetian blind which comprises slats which partially overlap in the closed position, and at least two flexible lifting elements, each passing through an aperture in each slat, the slats each having an edge portion which is offset and which extends upwards in the closed position of the blind. This edge portion is overlapped by the lower part of the slat next above with at least a lower section of the edge portion extending preferably at a very small angle with respect to the plane of the lifting element, the openings being located in a front portion of the slat adjacent to the offset edge portion. Preferably the openings extend somewhat into the offset edge portion. The shape and arrangement of the offset edge portion and of the apertures being such as to ensure guidance with minimum noise, minimum wear of the lifting elements, and at the same time complete exclusion of light.

BRIEF DESCRIPTION OF THE DRAWINGS

The construction and operation of the blind of this invention will be understood by those skilled in the art from the following description and the drawings in which.

DETAILED DESCRIPTION OF THE PREFERRED EMBODIMENT

Figures 1, 2, 3:
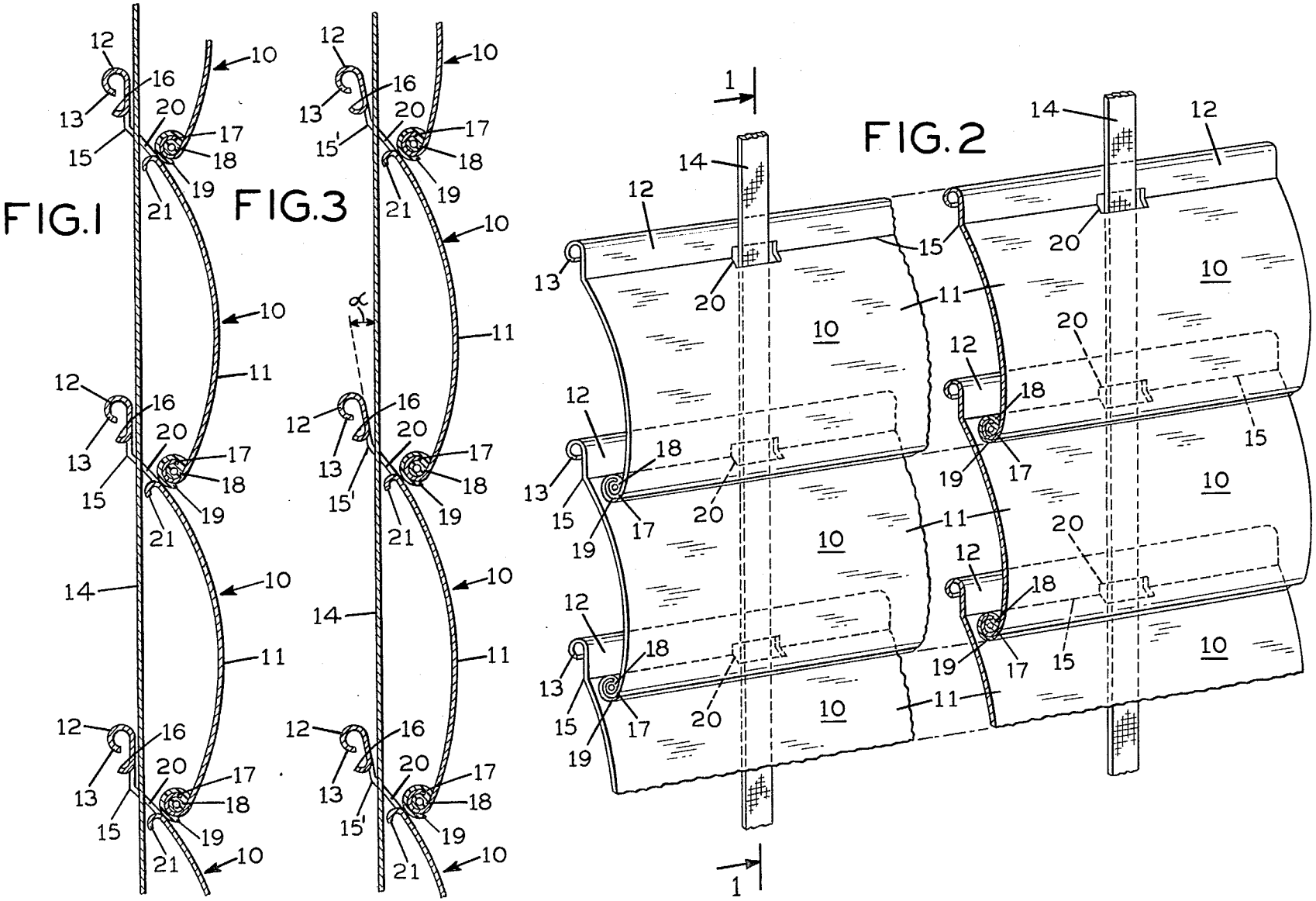
FIG. 1 is a vertical cross-section taken along line 1—1 of FIG. 2 of the blind of this invention in the closed position.
FIG. 2 is a perspective view of part of the blind shown in FIG. 1.
FIG. 3 is a view like FIG. 1 showing another embodiment of the invention.
Figure 2:
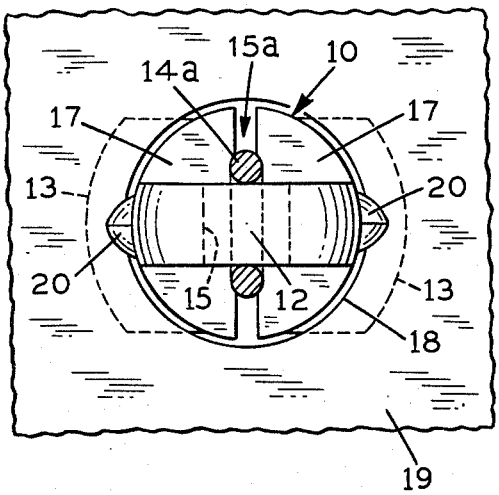
Figure 4:
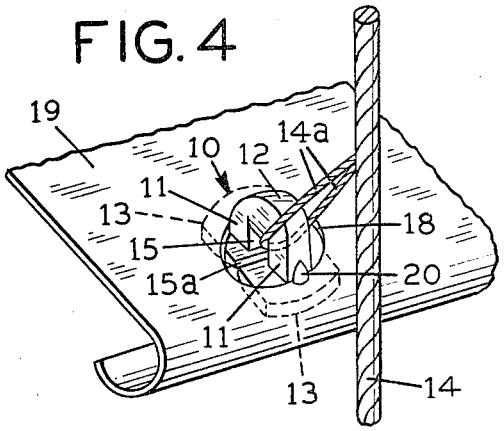
Figure 1:
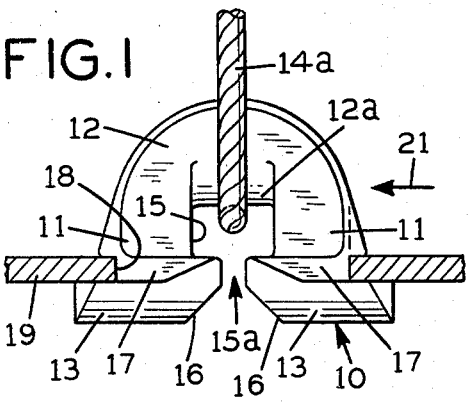
Figure 5:
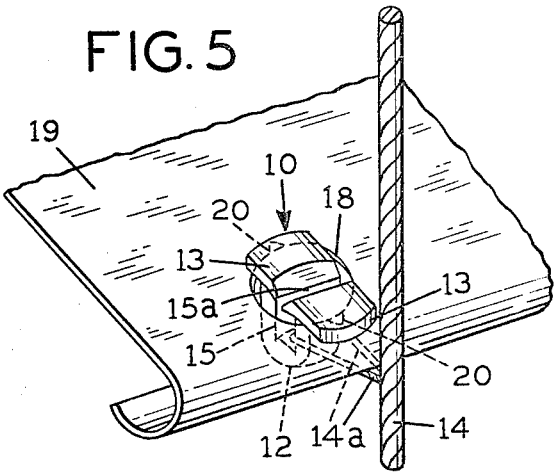
Figure 3:
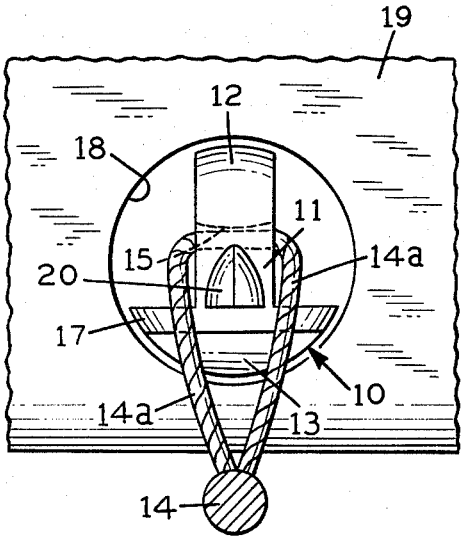
Figure 6:
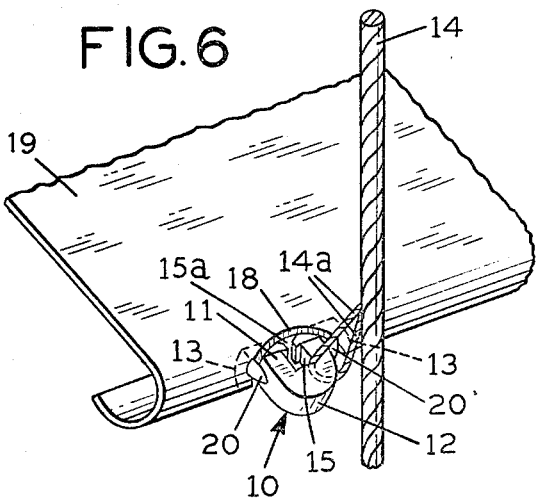

The slats 10 shown in FIG. 1 each have a front portion 11 with a convex outward curvature and an offset edge portion 12 which is off-set upwards at an angle in the closed position of the blind as shown. The upper terminal edge 13 of the edge portion 12 is rolled inwards. The front portion 11 and the edge portion 12 are defined by the bend line 15. The lower edge 17 of the slats 10 is likewise rolled inwards and is provided with a resilient sealing strip 18, with the aid of which the slats 10 come to rest on the front part 11 of the next lower slat 10 when the blind is in the closed position shown.

The sealing strip 18 may be of rubber plastic of the like and is held in place by the inward turn of the edge 17 whereby a portion of the strip 18 is gripped by the edge 17 while another portion 19 of the strip 17 lies in position to bear against the next lower slat 10 as shown.

Lifting elements serve for raising and lowering the blind. These lifting elements pass through openings 20. A part of each opening 20 is formed in the front portion 11. While all of the opening 20 may be formed in the front portion 11, it is preferred that a portion of opening 20 is formed in the offset edge portion. 22. By arranging the openings 20 so that they extend into the area of the offset edge portion 12 certain advantages are obtained.

The offset edge portion 12 of the slats 10 shown in FIG. 1 extends in a plane which is substantially parallel to the plane of the lifting elements 14 and extends upwardly beyond the lower edge 17 of the slat 10 next above far enough that it prevents a direct incidence of light when, due to external influences such as the wind, the light-tight closure is not achieved at all points along the sealing strip 13.

In the open position of the slats this arrangement of the openings 20 with a portion within the offset edge portion 12 provides a larger opening for passage of the lifting elements 14. Further, improved guiding between the lifting elements 14 and the slats 10, coupled with the least possible friction between the latter, is also achieved so that the slats move more quietly.

The slats 10 in FIG. 3 represent another and the preferred embodiment from the other slats 10 shown in FIG. 1. The slats 10 of FIG. 3 have offset edge portions 12 bent along line 15'. The bend along line 15' is such that there is an angle $\alpha$ between the offset edge portion 12 and the plane of the lifting elements 14. The angle $\alpha$ can amount to up to 10°. The preferred range of this angle is between 3° and 6° with 5° as shown being most preferred. Off-setting the edge portion 12 at the angle $\alpha$ has the effect that with slats of certain shapes a small range of tolerance is provided for compensating for any deviations from such shape, good contact of the lower edges of the slats with the next lower slat in closed position and, on the other hand, still provides the guiding and supporting functions already mentioned. Still further, the off-set edge portion 12 also serves to strengthen the slats 10.

Although the openings 20 may be simple die cut openings it is preferred that at least the upper edge 16 be curved as shown by bending the metal of the edge downwardly toward the under side of slats 10 and away from the lifting elements 14. It is preferred to also bend the front edge 21 away from the lifting elements 14 as well. If desired, the lateral side edges 22 may also be curved away from the lifting elements 14 to minimize any tendancy for the slats 10 to abrade or cut the lifting elements 14.

I claim:

1. An external venetian blind having a plurality of slats and at least two flexible lifting elements with each lifting element passing freely through an opening in each slat, said blind being of the type that in its closed position the slats partially overlap; characterized in that said slats include a main portion and an offset edge portion, said offset edge portion including a substantially planar portion adjacent said main portion, said offset edge portion extending upwardly from the main portion in the closed position of the blind, said offset edge portion being overlapped by the main portion of the slat thereabove in the closed position of the blind, and said openings for said lifting elements being located at least in part in the main portion of said slats.

2. The blind of claim 1 in which said offset edge portion is substantially parallel to the plane of the lifting elements in the closed position of the blind.

3. The blind of claim 1 in which said offset edge portion extends at an angle to the plane of said lifting elements when in the closed position of the blind.

4. The blind of any one of claims 1, 2 or 3 in which the openings for said lifting elements also extend partly into the offset edge portion of the slat.

5. The blind of any one of claims 1, 2 or 3 in which each of said slats have an edge opposite to said offset edge portion, said opposite edge having a resilient sealing strip therealong for bearing against the next lower slat.

6. The blind of claim 4 in which at least one of the edges of the openings for the lifting elements is curved out of the plane of the adjacent portion of the slat forming a rounded lip.

7. The blind of claim 5 in which the openings for said lifting elements also extend partly into the offset edge portion of the slat and at least one edge of each opening is curved out of the plain of the adjacent portion of the slat forming a rounded lip.

* * * * *

UNITED STATES PATENT AND TRADEMARK OFFICE

CERTIFICATE OF CORRECTION

PATENT NO. : 4,236,566

DATED : December 2, 1980

INVENTOR(S) : Erich E. Hensel

It is certified that error appears in the above-identified patent and that said Letters Patent are hereby corrected as shown below:

The sheet of drawings containing Figures 1-6 is to be cancelled.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*